US006353168B1

(12) United States Patent
Sosoka, Jr. et al.

(10) Patent No.: US 6,353,168 B1
(45) Date of Patent: Mar. 5, 2002

(54) EDUCATIONAL MUSIC INSTRUMENT FOR CHILDREN

(75) Inventors: John R. Sosoka, Jr., Long Beach; Brooke Abercrombie, San Marino; Brad Emerson, Costa Mesa, all of CA (US); Adam Gerstein, London (GB)

(73) Assignee: Neurosmith, LLC, Long Beach, CA (US)

( * ) Notice: Subject to any disclaimer, the term of this patent is extended or adjusted under 35 U.S.C. 154(b) by 0 days.

(21) Appl. No.: 09/518,471

(22) Filed: Mar. 3, 2000

(51) Int. Cl.[7] ..... G10H 7/00

(52) U.S. Cl. ..... 84/600; 84/476; 446/397; 446/408

(58) Field of Search ..... 84/470 R, 476, 84/600, 609; 446/397, 408

(56) References Cited

U.S. PATENT DOCUMENTS 4,287,568 A * 9/1981 Lester ..... 84/609 X
4,836,075 A * 6/1989 Armstrong
4,936,185 A * 6/1990 Yamaguchi et al. ..... 84/644 X
5,349,129 A * 9/1994 Wisniewski et al. ..... 84/600
5,451,178 A * 9/1995 Yorozu et al.
5,949,010 A * 9/1999 Hacker ..... 84/476
6,132,281 A * 10/2000 Klitsner et al. ..... 446/408 X

* cited by examiner

*Primary Examiner*—Jeffrey Donels
(74) *Attorney, Agent, or Firm*—Knobbe, Martens, Olson & Bear, LLP

(57) ABSTRACT

The educational music instrument is a musical toy that allows one or more musical sequences to be played. The toy includes a base with a signal processing unit and five receiving portions. The toy also includes five blocks which are configured to be inserted to the receiving portions. When the blocks are engaged with the receiving portions, a musical sequence or phase is played by the toy. The musical sequence played by the toy is dependent upon which face of the block is engaged with the receiving portion and different blocks preferably cause different musical sequences to be played. Accordingly, the musical toy can play numerous different musical sequences depending upon location and orientation of the blocks in the receiving portions.

40 Claims, 7 Drawing Sheets

EDUCATIONAL MUSIC INSTRUMENT FOR CHILDREN

BACKGROUND OF THE INVENTION

1. Field of the Invention

The present invention generally relates to musical instruments and, in particular, to educational musical instruments for children.

2. Description of Related Art

A variety of toys for children are known in the art and many of these toys generate different sounds. For example, U.S. Pat. No. 5,127,869 issued to Hanzawa is a sound producing toy including a board having a path and a plurality of animal figures drawn on the board along the path, and a toy sightseeing bus which is moved along the path. Electrically conductive members are formed on the path at positions opposing the animal figures for producing commands which specify the corresponding animals. A group of contacts are arrayed on the bottom of the toy bus in such a manner that the contacts come into sliding contact with the electrically conductive members. In particular, when the toy bus arrives at a position opposing an animal figure, a set of the contacts is closed selectively by the electrically conductive member corresponding to this animal figure so that the closed contacts generate a signal designating the animal. The toy bus is provided with a signal processing circuit for producing command signals corresponding to the animal figures and a speaker for producing the cries of the animals. Thus, this device simply matches the sound of an animal with a picture of that animal.

Another toy is disclosed in U.S. Pat. No. 5,429,513 issued to Diaz-Plaza which is an interactive teaching apparatus and a method of teaching graphemes, i.e., letter symbols of an alphabet; grapheme names, phonemes, and phonetics. The method includes the steps of utilizing a display of graphemes to learn the phonemes associated with the letters to form words; and forming words, phrases and sentences phonetically with a set of cards. Each of the cards includes at least one graphemes and an image positioned adjacent to the grapheme. Each card is color-coded with the same distinctive color used to color-code the grapheme on the display and an individually-activated, sound generating device is associated with each of the graphemes. Thus, this device requires numerous color-coded graphemes, images and sound generating devices.

U.S. Pat. No. 4,280,809 issued to Greenberg, et al. discloses an educational toy for testing a child's ability to properly associate related symbols. In particular, the toy includes an area for displaying two groups of symbols, and two members are movably mounted to the toy to allow the child to move a symbol from one group into alignment with a symbol from another of the group. In response to manual actuation of a switch, the toy emits a first signal to indicate correct performance if the symbols are correctly aligned and a second signal to indicate incorrect performance if the members are not properly aligned. The symbols are displayed on interchangeable cards to allow different symbols to be displayed so that the educational content of the toy can be varied simply by changing the cards. Disadvantageously, the toy only indicates whether the symbols are logically created and it does not develop the child's musical awareness or abilities.

A need therefore exists for a musical toy which eliminates the above-described disadvantages and problems.

SUMMARY OF THE INVENTION

One aspect of the present invention is a musical toy which allows one or more musical sequences to be played. The toy includes a base with a signal processing unit and machine readable storage media, and a plurality of receiving portions which are in communication with the signal processing unit. The toy also includes a plurality of blocks which are configured to engage the receiving portions, and when one of the blocks engages one of the receiving portions, a musical sequence or phase is played by the toy. In greater detail, the blocks are preferably shaped like a cube and each face of the cube is configured to engage a receiving portion. The musical sequence played by the toy is desirably dependent upon which face of the cube is engaged with the receiving portion and different cubes preferably cause different musical sequences to be played. Accordingly, the musical toy can play numerous different musical sequences depending upon which cube is engaged with a receiving portion and the orientation of the cube within the receiving portion.

Another aspect of the present invention is a musical toy which can play a series of musical sequences or phrases when a plurality of blocks are engaged with a plurality of the receiving portions. Preferably the musical sequences or phrases are played one after the other to create a succession of tones or a tune. The positioning and orientation of the blocks in the receiving portions determines which of a plurality of musical sequences is played by the toy. Significantly, the positioning and orientation of the blocks in the receiving portions is readily changeable to create different musical sequences. For example, one or more of the blocks may be rotated so that a different face of the block engages the receiving portion and that changes the musical sequence played by the toy and/or the positions of the blocks may be swapped or moved to change the order in which the musical sequences are played. The musical toy preferably includes a play button which may be activated to play the series of musical sequences.

Still another aspect of the present invention is it advantageously allows a child to create his or her own musical compositions, and this stimulates the musical interest of the child. Significantly, this also provides the foundation for successful learning. In greater detail, the musical toy allows children to create beautiful music simply by playing with different blocks. The blocks can be inserted into receiving portions at random or in carefully selected arrangements to create a composition. Significantly, because each block causes the musical toy to create different sounds and each side of the block creates yet another different sound, many different musical sequences and compositions can be constructed simply by mixing and matching blocks. This maintains a high interest level in the toy, because the musical combinations can be continuously changed to create new and varied musical compositions. Additionally, because different musical cartridges may be used in conjunction with the musical toy to create different types of music, millions of possible musical compositions may be created.

Yet another aspect of the present invention is an educational toy for children which allows one or more musical sequences to be played according to a pattern determined by a child. The toy includes a base with a signal processing unit and machine readable storage media, a plurality of receiving portions including a first contact which is in communication with the signal processing unit, and a plurality of blocks configured to engage the receiving portions. Each of the blocks includes a second contact which is configured to be in communication with the first contact when the block is engaged with a receiving portion. The educational toy advantageously can play a single musical sequence or phrase when a single block is engaged with a receiving portion, or the toy can play a plurality of musical sequences when a plurality of blocks are engaged with a plurality of receiving portions. The musical sequences can be readily changed by rotating and/or moving one or more of the blocks. Additionally, the toy preferably includes one or more speakers which produce sounds corresponding to an output signal from the signal processing unit.

In yet another aspect, each block is individually identified by a unique symbol or marking—such as color, texture or other distinguishing features—and the blocks are preferably shaped like a cube. Desirably, each side of the block has different indicia—such as letters, numbers, shapes or patterns—to identify a particular side of the block. Advantageously, this allows the blocks to be arranged, for example, according to color and the shapes on the sides of the blocks. Thus, a child can devise, generate and create specific musical compositions by arranging the blocks according to color and shape into specific patterns, or the child can randomly create patterns. Significantly, with literally thousands or even millions of possible combinations and musical compositions available depending upon the arrangement and orientation of the blocks, the child can use the device for extended periods of time without losing interest in the toy.

Advantageously, the musical toy is educational and informative because it enables children to create music while playing. For example, by comparing and contrasting the different sounds, children can learn the basic characteristics of music. The musical toy also encourages children to interact with the more meaningful and intricate aspects of music by arranging and composing different musical compositions. In addition, the musical toy allows sophisticated musical compositions to be created, which further stimulates development and learning by children.

Still another aspect of the invention is a musical toy which allows one or more musical sequences to be played. The musical toy includes a base with a programmable computer and computer readable memory storage. The computer is configured to produce one or more output signals and receive one or more input signals. The toy also includes a speaker which is in communication with the computer and configured to produce sounds corresponding to an audio output signal from the computer. In addition, the toy includes a plurality of first receiving portions in communication with the computer, each of the first receiving portions including a sensor, and a plurality of objects having at least one portion configured to contact at least one of the first receiving portions. When one of the objects is in contact with one of the first receiving portions, the computer determines which of the objects is in contact with which of the first receiving portions and a predetermined musical sequence is played by the toy. Preferably, each of the objects has a plurality of portions configured to contact at least one of the first receiving portions, and the musical sequence played by the toy is determined at least in part by which of the plurality of portions of the object is in contact with one of the first receiving portions. Additionally, the toy preferably includes a second receiving portion which is in communication with the computer, and a cartridge is configured to contact the second receiving portion to program the computer to play preselected music.

Yet another aspect of the present invention is a toy including a base with a speaker, a signal processing unit and a plurality of receiving portions. The toy also includes a plurality of blocks, each of the blocks including a plurality of sides configured to contact one of the receiving portions, means for determining which block is in which receiving portion, and means for playing a musical sequence when one or more blocks are inserted into one of the receiving portions. The musical sequence is preferably determined at least in part according to which of the plurality of blocks is in which of the plurality of receiving portions and the musical sequence is preferably determined at least in part according to which one of the plurality of sides of the plurality of the blocks is in which of the plurality of receiving portions.

A further aspect of the present invention is a device which allows musical sequences to be played. The device includes a base with a signal processing unit, machine readable storage media, and the processing unit is configured to receive music sequence data and to send an audio signal to a speaker. The device also includes a speaker configured to receive the audio signal and produce sounds corresponding to the audio signal, a plurality of receiving portions in communication with the processing unit, and a plurality of blocks having a surface configured to engage one of said receiving portions. The device plays one or more musical sequences according to the placement of the blocks in the receiving portions. Preferably, each block causes the device to play a different musical sequence and the sequence of the blocks in which the musical sequences are played. Additionally, the device preferably includes a start button in communication with said signal processing unit, wherein activation of the start button causes the device to play one or more musical sequences. The device preferably also includes a replaceable cartridge in communication with the signal processing unit. The replaceable cartridge is configured to provide different musical data to the processing unit to allow the device to play different types of music. Significantly, completely different musical sounds can be produced by the toy by changing the cartridge.

The toy is advantageously simple to manufacture, portable and sturdy for use by children. In particular, the base and blocks are preferably constructed from a rigid plastic material to withstand use by children. Additionally, the toy is easy to use because the blocks are simply pressed down into the receiving portions, or the start button is activated to cause the device to play. Further, the toy is reliable and easy to maintain because there are no moving parts within the toy, no adjustments or modifications are required, and no assembly of the toy is required. Finally, the toy is practical and useful because it can be used by children and adults of all ages and skill levels.

Applicants believe that the musical toy allows very young children to play with music in a meaningful way because, by simply moving and rotating the blocks, they discover the basic characteristics of music. This permits children to explore variations in sound, and originate rhythms and melodies of their own creation. As children grow and mature, they begin to recognize the patterns and musical form created by the blocks. Therefore children can then begin to learn about musical composition and musical themes.

Applicants also believe that the musical toy assists in the development of a child's brain. As known, the brain experiences phenomenal growth in the early years of life. At birth, an infant's brain has fewer synapses or connections between brain cells than an adult's brain and by about age two the brain activity of a child is about the same as an adult. At about age three, a child's brain has about 1,000 trillion connections which is nearly twice as many as an adult. Thus, between birth and about three years of age, critical connections of the brain are established. These connections are the foundation for thought, language, logic and creativity.

Applicants believe that more than anything else, experience influences the creation of these connections. In particular, because babies and children learn by touching, seeing, hearing and tasting, these activities stimulate the brain and assist in establishing these critical connections. The musical toy allows children to develop these connections and stimulates brain growth.

Significantly, because music stimulates several regions of the brain, the musical toy may assist in developing the neurological pathways which are used during high-level cognitive skills such as math and reading. For instance, because music presents sound in a logical manner, i.e., keys and notes are fixed in space and describe a particular sound or arrangement, this may benefit development of spatial reasoning skills. Spatial reasoning skills, which are the ability to understand the relationship of objects in space, is an important part of the abstract reasoning skills that the brain uses to perform common, everyday activities such as walking and complex functions such as solving math and scientific problems.

Further, Applicants believe that the musical toy assists in developing reading skills. For example, music and reading both rely on the ability to discriminate pitch and to hear the difference between sounds. An important part of learning to read is learning the relationship between a letter and its spoken sound. Music facilitates this stage of learning in which children "sound out" syllables and words. Further, one of the many ways of knowing music is the ability to listen attentively and perceptively to music. The development of musical listening remains one of the most universal educational goals and listening is a crucial skill for socialization, communication and conversation. Listening to music helps develop these critical listening skills, and Applicants believe that listening to the sounds created by the musical toy and allowing children to create and develop their own musical compositions will further their listening skills.

Further aspects, features and advantages of the present invention will become apparent from the detailed description of the preferred embodiments that follows.

BRIEF DESCRIPTION OF THE DRAWINGS

The appended drawings contain figures of preferred embodiments of the present musical toy. The above-mentioned features of the musical toy, as well as other features, will be described in connection with the preferred embodiments. However, the illustrated embodiments are only intended to illustrate the invention and not limit the invention. The drawings contain the following figures.

DETAILED DESCRIPTION OF THE PREFERRED EMBODIMENT

The present invention involves a musical toy. The principles of the present invention, however, are not limited to musical toys. It will be understood that, in light of the present disclosure, the musical toy disclosed herein can be successfully used in connection with other types of musical instruments, educational materials and toys.

Additionally, the musical toy of the present invention is intended to be an educational product which is directed towards children. In particular, the toy is intended to stimulate learning and mind development for children between the ages of about two and six years. The toy is also intended to increase the auditory and visual abilities of the child, and it may be used to develop a wide range of abilities and skills. It will be appreciated, however, that the musical toy can be used for many different purposes. For example, the musical toy may be connected to a music system and/or other musical components. Further, the musical toy may be used by persons of all ages and abilities.

Further, to assist in the description of the musical toy, words such as top, bottom, front, rear, right and left are used to describe the accompanying figures. It will be appreciated, however, that the present invention can be located in a variety of desired positions—including various angles, sideways and even upside down. A detailed description of the musical toy now follows.

Figure 1:
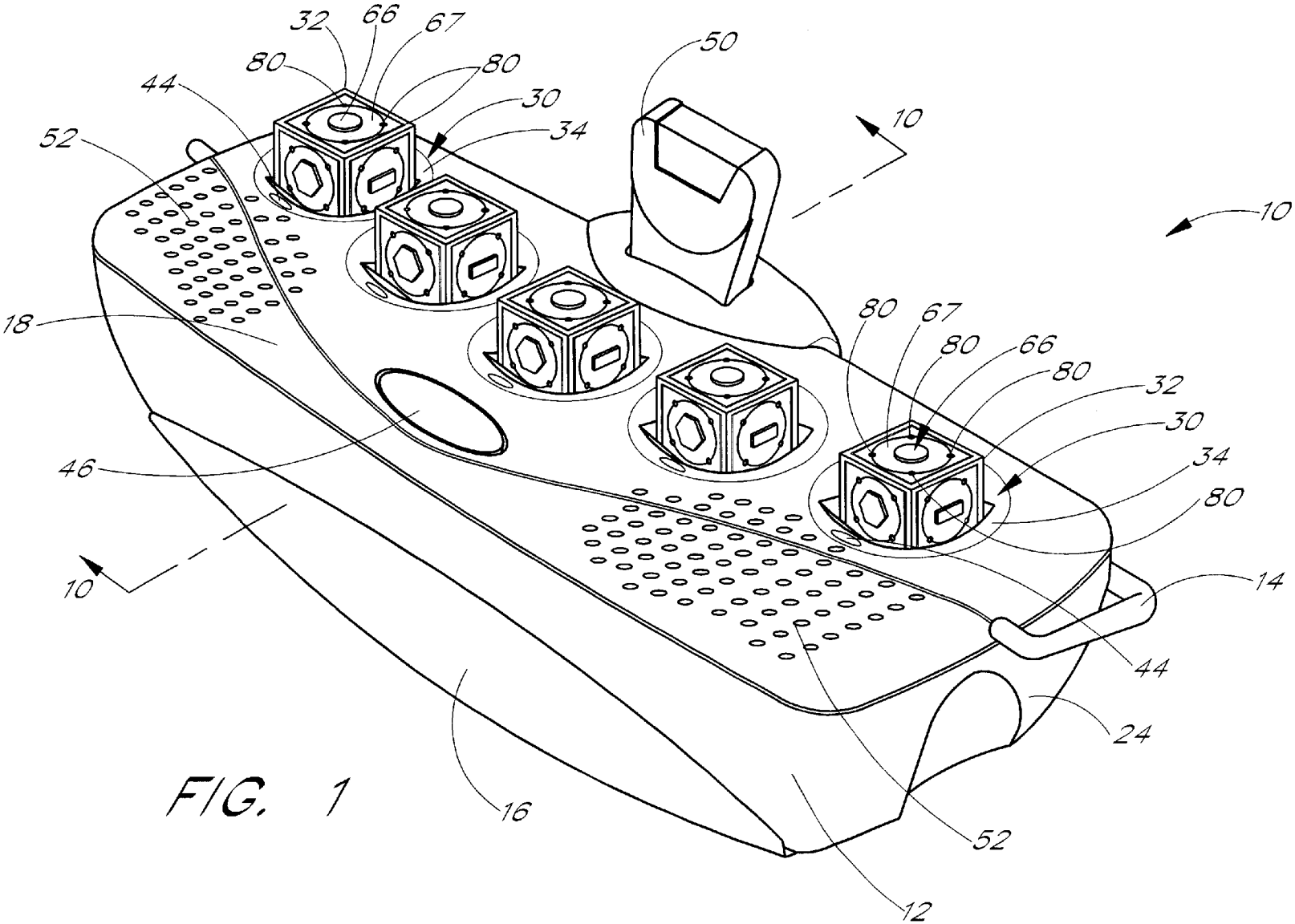
FIG. 1 is a perspective view of the musical toy in accordance with a preferred embodiment of the present invention.

As seen in FIG. 1, the musical toy 10 includes a base 12 with a pivotably attached handle 14. The base 12 is generally rectangular in configuration with a front surface 16, top surface 18, back surface 20, bottom surface 22, right side 24 and left side 26. The base 12 is about 14 inches in length and it has a width of about 5 inches, but the base may have any desired dimensions and configuration. The base 12 is preferably constructed of a rigid plastic material such as polyurethane or polyethylene to produce a strong, sturdy, lightweight and portable toy for use by children, but the toy may be constructed from any suitable material.

Figure 2:
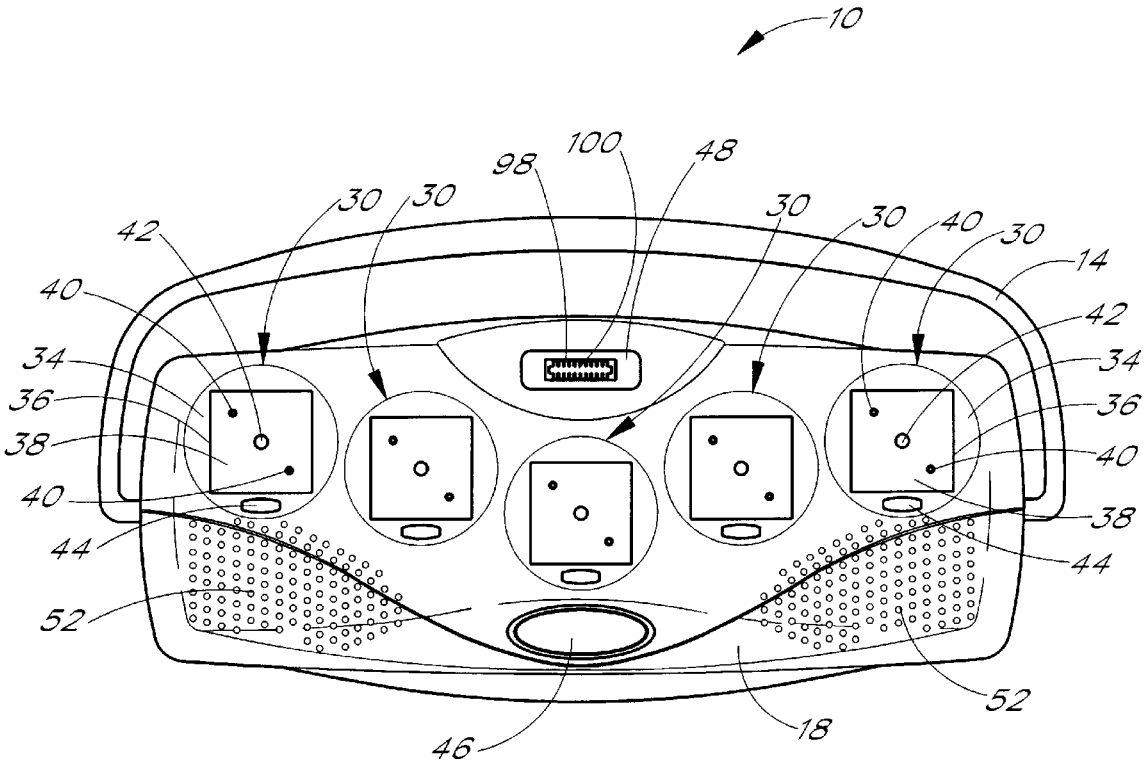
FIG. 2 is a top view of the musical toy shown in FIG. 1.

The top surface 18 of the base 12 includes a plurality of receiving portions 30 which are configured to receive blocks 32, which are described in greater detail below. As best seen in FIG. 2, the receiving portions 30 include a curved or rounded surface 34 which leads to a generally square-shaped lower portion 36 with a generally square-shaped floor 38. The floor 38 of each receiving portion 30 includes two contacts 40 and a switch 42 which is generally centrally located on the floor. Although five receiving portions 30 and five blocks 32 are illustrated in the accompanying figures, it will be understood that the musical toy 10 may include any desired number of receiving portions and/or blocks. It will also be understood that the receiving portions 30 may also protrude outwardly from the base 12, aligned with the top surface 18 of the base or have other desired configurations depending, for example, upon the size and shape of the blocks 32. Positioned near each of the receiving portions 30 is an indicator 44 such as a light, lamp, light emitting diode (LED), but it will be understood that the toy 10 does not require the indicators. The top surface 18 of the base 12 also includes a play button 46, a second receiving portion 48 to receive a cartridge 50 and two speaker grills or covers 52 which protect speakers 54 located within the base 12. The speaker grills 52 are formed by a plurality of holes which extend through the top surface 18 of the base 12, but the speaker grills could also include slots or other types of openings. Further, the speaker grills could include a covering or other structure which allows sounds from the speakers to be heard by the user.

Figure 3:
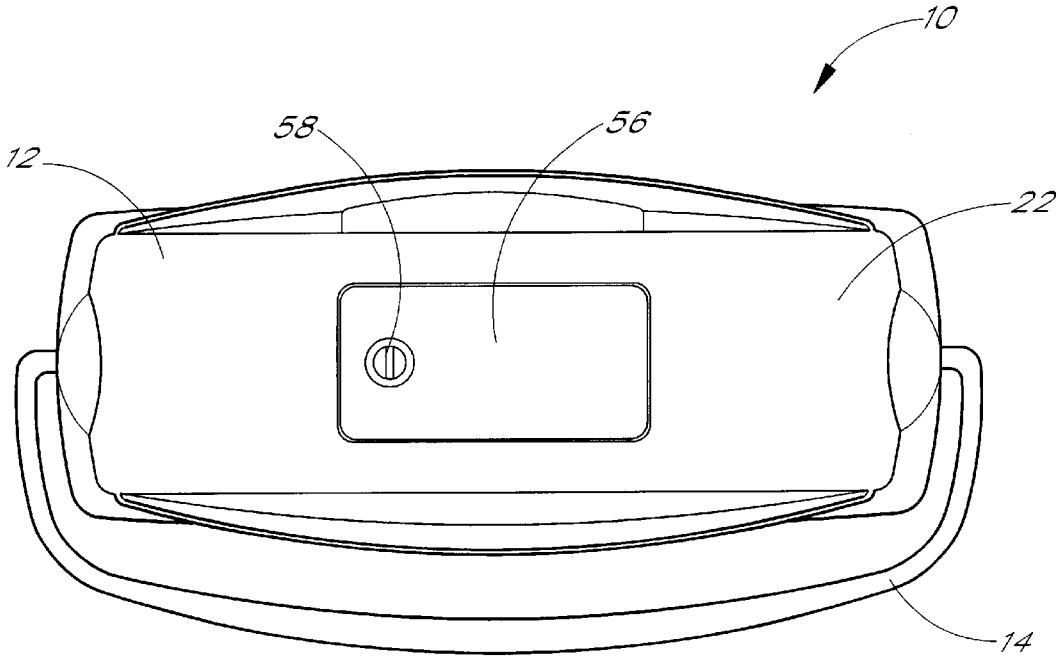
FIG. 3 is a bottom view of the musical toy shown in FIG. 1.
Figure 4:
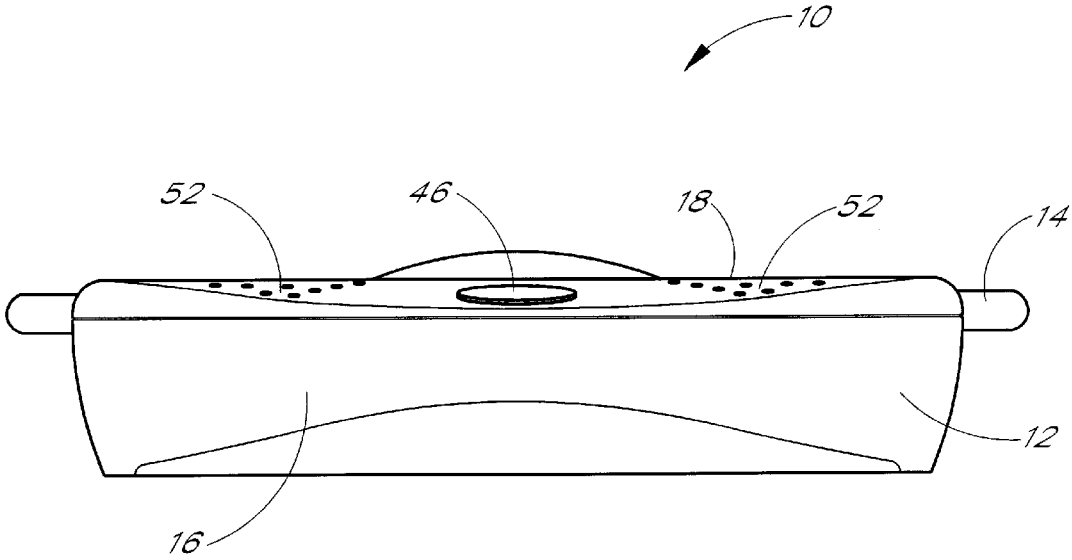
FIG. 4 is a front view of the musical toy shown in FIG. 1.
Figure 5:
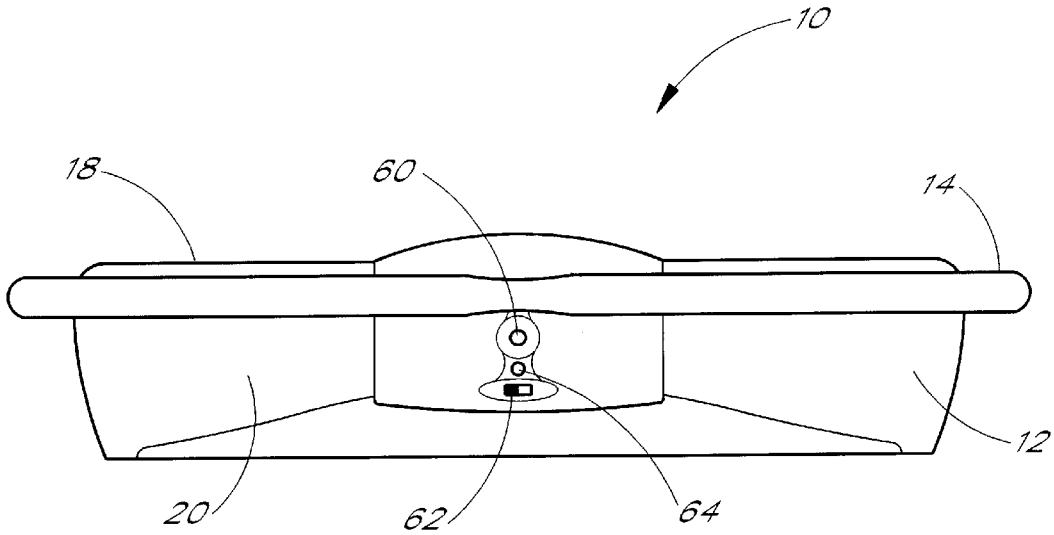
FIG. 5 is a back view of the musical toy shown in FIG. 1.
Figure 6:
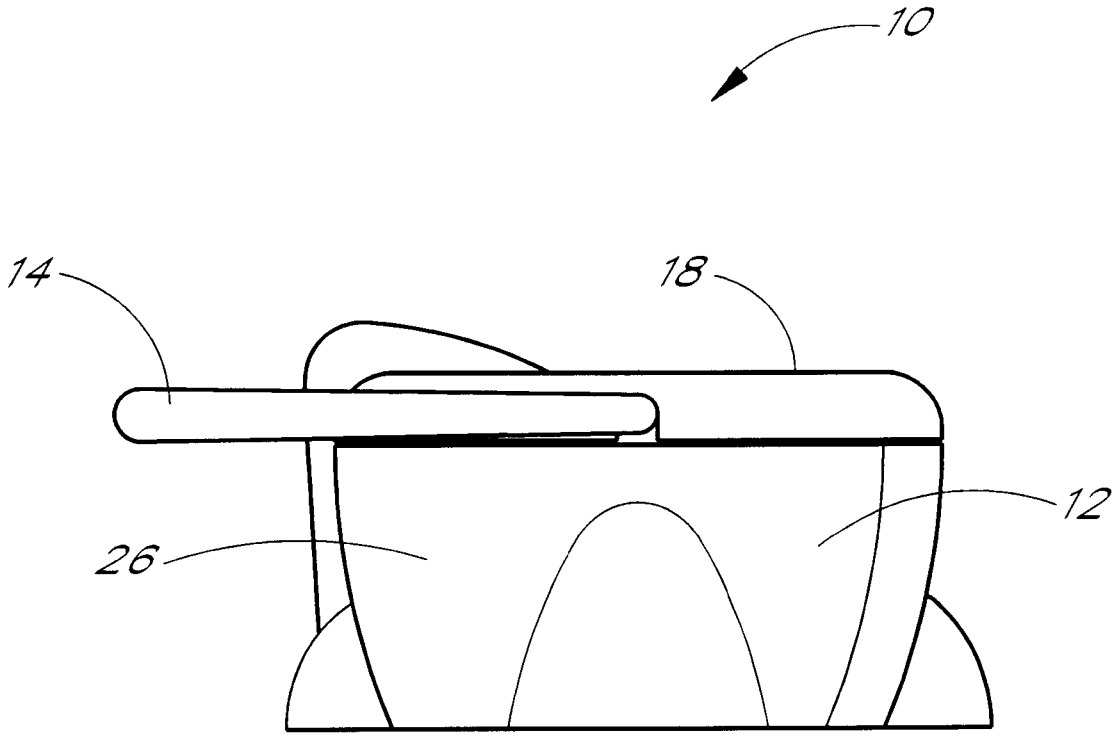
FIG. 6 is a side view of the musical toy shown in FIG. 1.

As seen in FIG. 3, the musical toy 10 includes a generally rectangular bottom surface 22 with a lid 56 covering a power source such as batteries. Preferably, four "C" size batteries are used to power the toy 10, but any number and size of batteries or other suitable power source may be used to power the toy. The lid 56 is preferably held in a closed position by a fastener 58 such as a screw. As seen in FIG. 5, the back surface 20 includes a reset button 60 which is used to reset the electronics of the toy 10 and a volume switch 62 which allows low or high volume to be selected by the user. It will be appreciated that any known type of volume control may be used in connection with the musical toy 10. The back surface 20 also includes a standard head phone jack 64 which allows a user to use headphones while using the toy 10 instead of the speakers 54.

Figure 7:
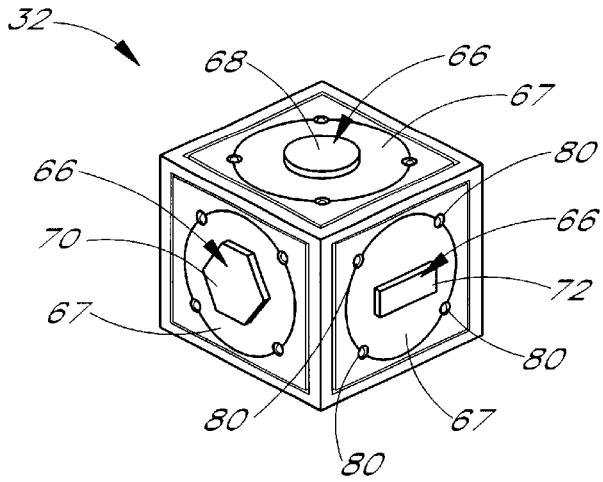
FIG. 7 is a perspective view of a block in accordance with a preferred embodiment of the present invention, illustrating various indicia on the faces of the block.
Figure 8:
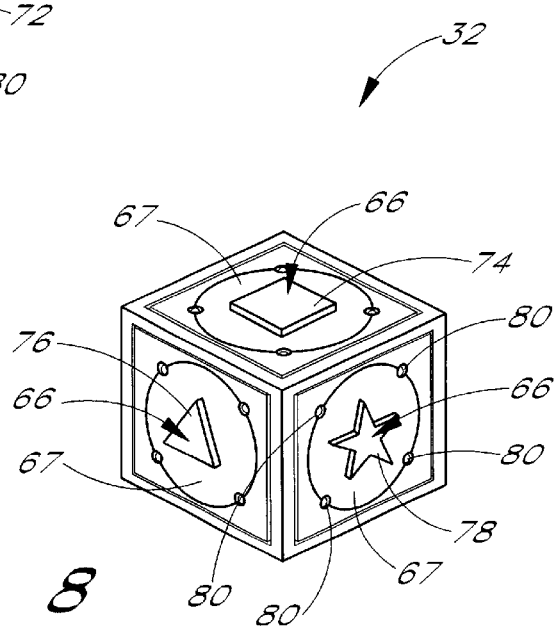
FIG. 8 is a perspective view of the block shown in FIG. 7, illustrating various indicia on the faces of the block.

As shown in FIGS. 1, 7 and 8, the blocks 32 are preferably in the shape of a cube, but the blocks may have any desired shape, configuration and number of sides including triangular, hexagonal, octagonal, etc. Each face of the block 32 includes indicia 66 which is located in a recessed portion 67 and each block includes at least one surface which is configured to contact a receiving portion 30. The indicia 66 on the faces of the block 32 may include any marking or symbol—such as colors, objects, letters, numbers, etc.—which identifies the different faces of the block 32. For example, as seen in FIGS. 1 and 7, the indicia 66 on three sides of the block includes a circle 68, a hexagon 70 and a rectangle 72. As seen in FIG. 8, the indicia 66 on the other three sides of the block 32 includes a square 74, a triangle 76 and a star 78. It will be understood, however, that the indicia 66 may compose any desired mark or symbol and that the same indicia may be used on more than one of the faces of the block 32.

The indicia 66 preferably represents various arrangements of a musical theme and each face of the block 32 contains about two measures of music, but each block could contain a single musical note, a musical phrase or musical notes of any desired length. For example, in a preferred embodiment, the square 74 represents woodwinds such as a clarinet, flute and bassoon; the circle 68 represents violins; the triangle 76 represents an ensemble of sounds such as a bassoon, oboe, celesta, sleigh bells and whistle; the star 78 represents trumpets with wood blocks, piano and french horns; the hexagon 70 represents a xylophone with pizzicato strings and the rectangle 72 represents voices. It will be understood that the indicia may represent any musical arrangement, theme or musical instruments, and any combination of instruments or sounds.

Although not shown in the accompanying figures, the blocks 32 are preferably individually identified by color, but the blocks may be identified by any suitable means such as texture, size, shape, etc. In particular, the blocks 32 preferably have different colors such as red, orange, yellow, green and blue so that the different blocks can be readily identified. Advantageously, the blocks 32 can also be arranged according to color, such as the colors of the rainbow. This may allow the blocks 32 to be organized into a specific arrangement so that the musical sequences are played in a particular order.

As seen in FIGS. 1, 7, 8, 10A and 10B, each face of the block 32 includes four contacts 80 which are placed in the corners of a generally square-shaped pattern which is positioned proximate the indicia 66. The contacts 80 are electrically connected inside of the block 32 and the contacts are configured to be in electrical contact with the contacts 40 located in the floor 38 of each receiving portion 30 when the block is inserted into the receiving portion. This allows an electrical connection between the block 32 and the base 12 to be established.

Figure 9:
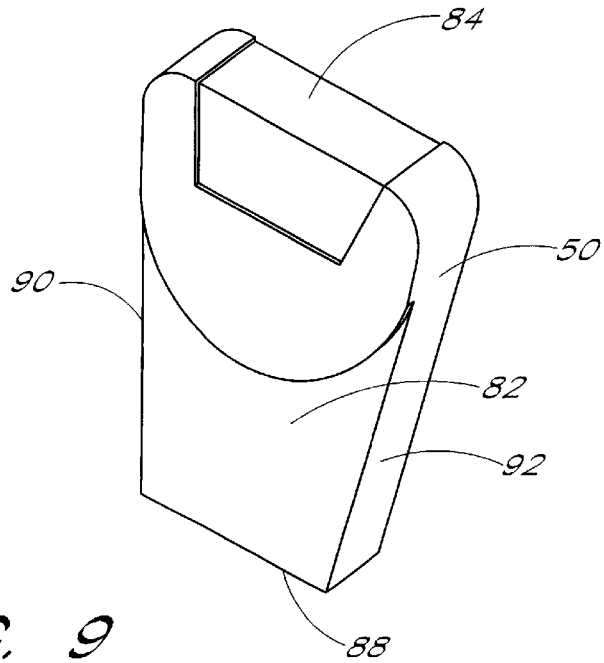
FIG. 9 is a perspective view of a cartridge in accordance with another preferred embodiment of the present invention.
Figure 10A:
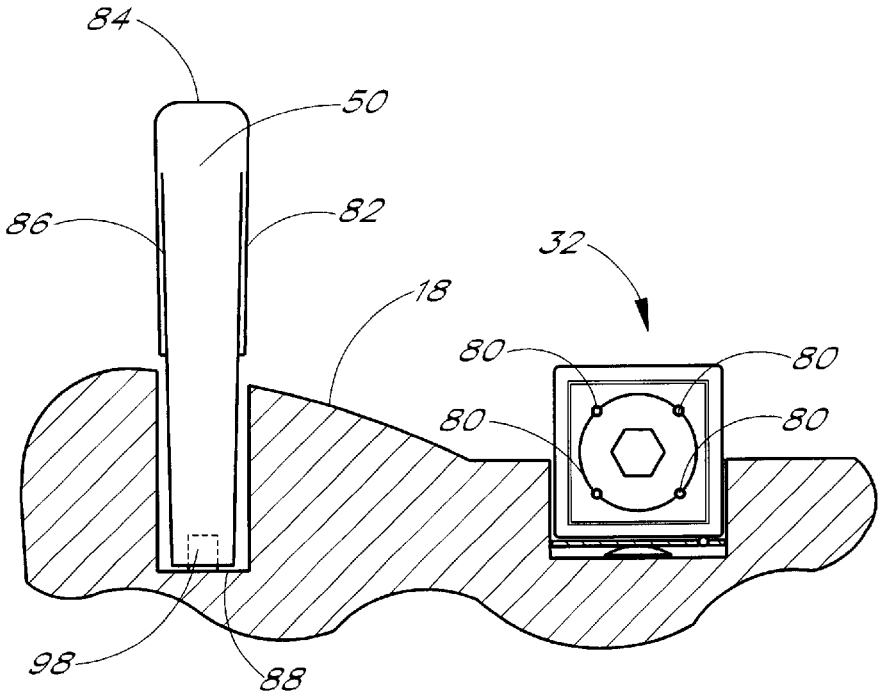
FIG. 10A is a partial cross-sectional side view along lines 10—10 of the musical toy shown in FIG. 1 with the musical toy partially cut away.
Figure 10B:
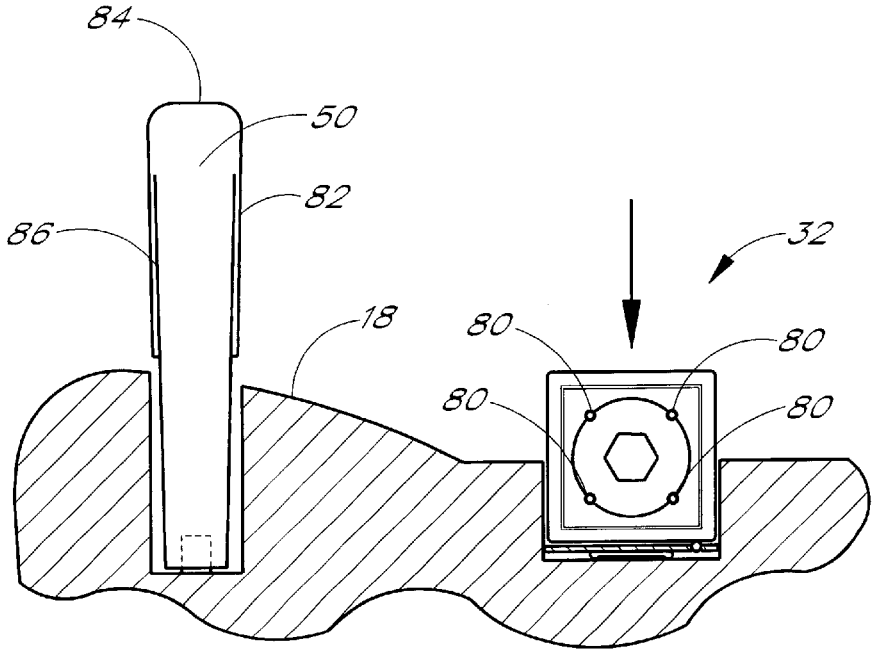
FIG. 10B is a partial cross-sectional side view along lines 10—10 of the musical toy shown in FIG. 1 with the musical toy partially cut away, illustrating an exemplary block engaged with a receiving portion.

As seen in FIG. 9, the cartridge 50, which is about 2 inches in height and about 1 ½ inches in width, includes a front surface 82, top surface 84, back surface 86, bottom surface 88, right side 90 and left side 92. As best seen in Figures 10A and 10B, the bottom surface 88 of the cartridge 50 includes a downwardly extending portion 94 with one or more connectors 96 which are sized and configured to be inserted the second receiving portion 48 of FIG. 2. In greater detail, the second receiving portion 48 includes an upwardly extending portion 98 which includes an opening 100 which is sized and configured to releasably engage the downwardly extending portion 94. The connection of the downwardly extending portion 94 and the upwardly extending portion 98 allows communication between the cartridge 50 and the receiving portion 48.

In a preferred embodiment, the cartridge 50 is based on music composed by Wolfgang Amadeus Mozart and includes several arrangements on a theme from Eine Kleine Nachtmusik. Of course, the cartridges 50 can have any desired theme, style, phrases or type of music such as orchestra, rhythms, blues, rock, percussion, etc. For example, in another preferred embodiment, the cartridge 50 includes different orchestra sounds. In this preferred embodiment, the indicia 66 on the faces of the blocks 32 may use symbols such as the square 74 which represents the violin; the circle 68 represents the bassoon; the triangle 76 represents the flute; the star 78 represents the trumpet; the rectangle 72 represents the piano and the hexagon 70 represents an ensemble of all these instruments. In another example, the cartridge 50 may include rhythms of the world. In this example, the square 74 represents American march rhythms with snare drum, crash cymbals, bass-drum, woodblock, tambourine, triangle, chimes and orchestra bells; the circle 68 represents native American rhythms including pow wow drums plus rattles, shakers, triangle, ankle bells, bird whistle and cymbals; the triangle 76 represents african beat rhythms including voice percussion with conga drums, shakers and tin cans; the star 78 represents an exotic blend of rhythms including East Indian table drum, Uda clay drum, assorted hand drums, African Kalimba, Guiro and tin cans; the rectangle 72 represents singles includes slide whistle and Jew's harp, clacker, vibra-slap, whistle and a fexitone; and the hexagon 70 represents energy-contemporary percussion rhythms including tom-toms, electronic percussion, cowbells, wood blocks, shakers and a whistle. As discussed above, the indicia may represent any musical arrangement, theme or musical instruments, and any combination of instruments or sounds.

In one embodiment of the invention, the toy 10 includes an electronic control circuit with a signal processing unit 102 located within the base 12. The signal processing unit 102 may include or consist of any suitable type of controller, microcontroller, processor, general or special purpose computer, etc. The signal processing unit 102 preferably includes machine readable memory 104 that stores a series of commands or steps. The memory 104 is preferably read only memory (ROM) which is used to store commands and data, including sound data. It will be appreciated that any type of memory, including random access memory (RAM), may also be used to store any desired data.

An input interface 106 and an output interface 108 are preferably in communication with the signal processing unit 102. In a preferred embodiment, the input interface 106 is in communication with the first receiving portions 30, second receiving portion 48, reset button 60 and volume switch 62; and the output interface 108 is in communication with the speakers 54 and headphone jack 64. As known to those skilled in the art, any number of various devices and components may be connected to the signal processing unit 102, input interface 106 and output interface 108.

It will be readily appreciated that Applicants are using the terms signal processing unit and processor in general terms, and that one of ordinary skill in the art will understand that a signal processing unit or processor can include a variety of combinations of hardware and software that can be used to execute a series of steps.

When the musical toy 10 is initially provided with power from batteries located in the battery compartment or when the cartridge 50 is installed in the second receiving portion 48, the signal processing unit 102 goes through an initialization sequence. During this sequence, the initial memory values are stored in the memory 104 and the indicators 44 proximate each receiving portion 30 are activated such that the toy 10 is now ready for use. If there is no activity or use of the toy 10 within a period of a few seconds to several minutes, the toy will go into a "sleep" mode where the toy uses very little power. This significantly increases the life of the batteries used to power the toy 10. On the other hand, if the toy 10 is activated by pushing a block 32 into a receiving portion 30 or depressing the play button 46, the toy will go into the "awake" mode. Preferably, each time the toy 10 goes into the awake mode, the signal processing unit 102 proceeds through an initialization sequence and each indicator 44 located proximate a receiving portion 30 is activated. More preferably, the toy 10 proceeds directly into the awake mode without any activation of the indicators 44 or initialization of the signal processing unit 102, and the toy responds immediately to the input.

Figure 11:
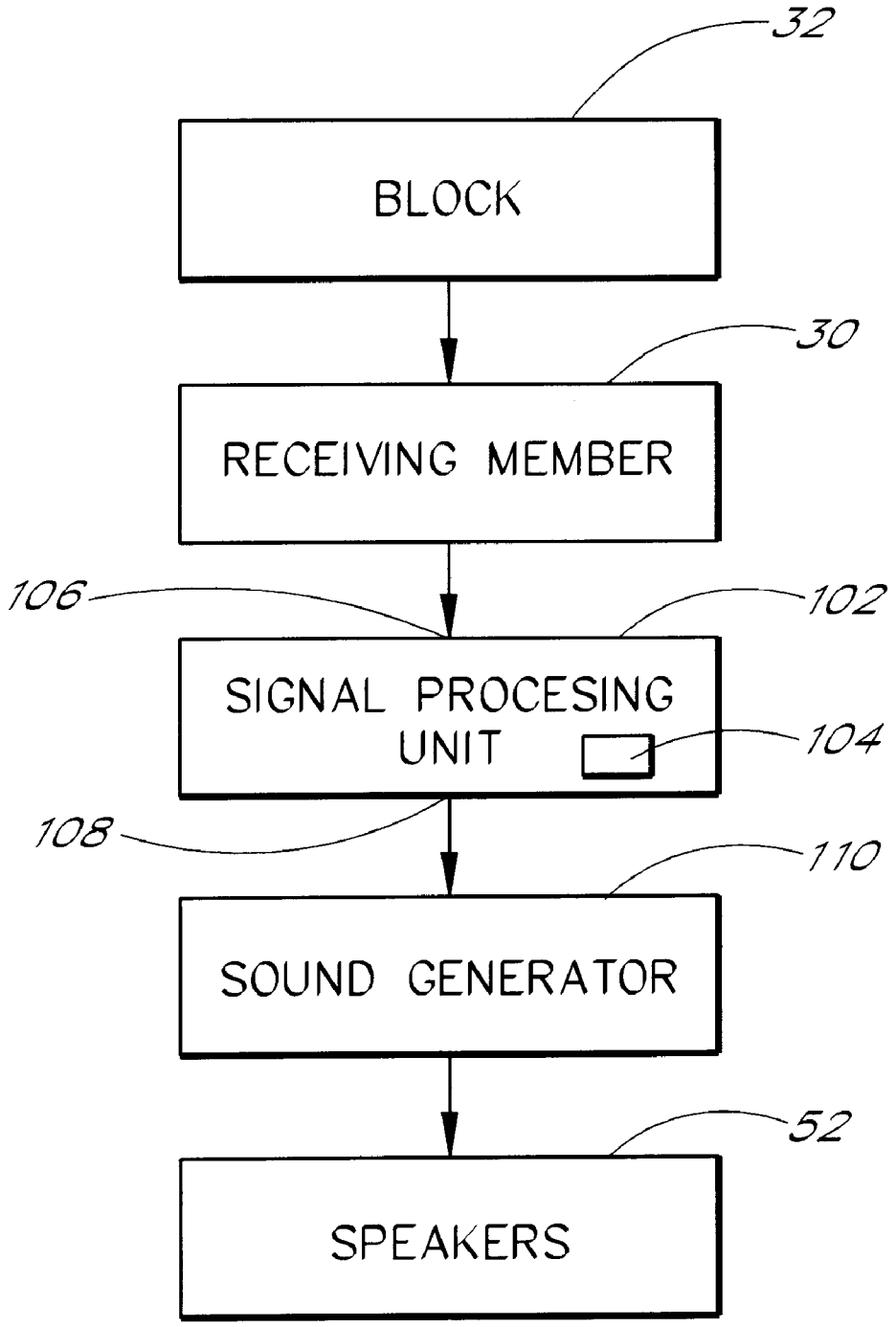
FIG. 11 is a flow chart of the operation of the musical toy in accordance with a preferred embodiment of the present invention.

The general operation of the toy 10 is shown in the flow chart contained in FIG. 11. When a block 32 is connected to a receiving member 30, an electrical connection is established and information is communicated to the signal processing unit 102. The signal processing unit 102 uses this information to determine which musical sequence should be played. The signal processing unit 102 then sends a signal to a sound generator 110 and audio signals are sent to the speakers 52. The speakers 52 then generate sounds corresponding to the audio signals.

In greater detail, when a block 32 is inserted into one of the receiving portions 30, the switch 42 is triggered. It will be understood that the block 32, as shown in FIG. 10B, needs to be pushed into the receiving portion 30 with sufficient force to trigger the switch 42. The switch 42 is preferably a momentary switch, but any suitable switch may also be used. The switch 42 communicates with the signal processing unit 102 to inform the toy 10 that a block 32 is located in a specific receiving portion 30. The signal processing unit 102 uses standard matrix keyboard techniques to determine which block 32 is engaged with which receiving portion 30.

Additionally, the contacts 80 on each face of the block 32 are connected by a resistor and when the block is engaged with the receiving portion 30, the contacts 40 in the receiving portion are electrically connected with the contacts 80 of the block. The resistor in the block 32 forms, with an internal series resistor and capacitor, an RC circuit. The circuit, with an 74HC14 Schmitt Trigger, forms an oscillator and the period of the oscillation is determined by the signal processing unit 102, which is preferably an SPC microcomputer. The signal processing unit 102 matches the period of oscillation with values stored in a table in the memory 104 to obtain a unique identification code. The signal processing unit 102 determines the corresponding sound file that is associated with the identification code and the sound generator 110 sends an audio signal to the speakers 54. It will be understood that one skilled in the art can use other known parts and components to determine which block is engaged with which receiving portion. The indicator 44 preferably indicates which of the blocks 32 is inserted into the receiving portion 30 and causing the musical sequence that is currently being played.

Accordingly, the music associated with a single block 32 can be played by pushing that block into a receiving portion 30. The musical sequence can then be varied, for example, by rotating the block and then reinstalling the block into the receiving portion. Alternatively, another musical sequence can be played by installing a different block 32 into a receiving portion 30. If another block 32 is pushed into another receiving portion 30 while the music associated with the first block is still being played, that music will be interrupted and the identification of the new block will be determined and the music associated with this new block will be played.

The musical toy 10 can also be directed to play music by activating the play button 46. When the play button 46 is depressed, each of the receiving portions 30 are read from right to left as shown in the accompanying figures using the above-described process. As the music associated with each block 32 is being played, the indicator 44 proximate that receiving portion 30 indicates which block is determining which musical sequence is being played. When all of the music associated with the blocks 32 have been played, the music stops. The play button 46 can then be activated again to play the same musical sequence or the blocks may be rotated and/or placed in different locations to create a new musical sequence.

During the use of the musical toy 10 by a person such as a child, the user inserts the card or cartridge 50 into the receiving portion 48 on the upper surface 18 of the base 12. The cartridge 50 is used to instruct the toy 10 to generate the desired type of music. For example, the cartridge 50 may instruct the toy 10 to generate sounds related to jazz, blues, classical, modern or other desired types of music. Additionally, the cartridge 50 may instruct the toy 10 to generate different types of sounds such as vocals, strings, horns, etc. Advantageously, the cartridge 50 can be readily changed such that the user can select different types of music or sounds.

The user then inserts the blocks 32 into the receiving portions 30 on the upper surface 18 of the base 12. The blocks 32 can be arranged by the user in any desired order and/or orientation. Advantageously, the indicia 66 on the faces of the blocks 32 and the colors of the blocks may be used to arrange the blocks in the desired order and/or orientation. The user then touches the play button 46 and the toy 10 generates a series of sounds according to the sequence and orientation of blocks. The user can then rearrange the blocks 32 and press the play button 46 again to generate a different series of sounds. The user, therefore, can arrange the blocks to create different sounds, rhythms, musical sequences, etc.

Significantly, the blocks 32 with the different faces allows the user to create many different musical sequences, patterns and tunes. The toy 10 may also include different sets of blocks 32 to create different types of sounds or music. In addition, the sound pattern can be easily changed by altering the location and/or orientation of one or more of the blocks 32, and/or changing the cartridge 50. Thus, the toy 10 allows the user to develop their auditory and visual skills by arranging the blocks 32 according to the desired color, india 66 and musical sequence.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A musical toy which allows one or more musical sequences to be played, the toy comprising:

a base with a signal processing unit and machine readable storage media;

a plurality of receiving portions, each of said receiving portions is in communication with said processing unit; and a plurality of blocks, each of said blocks including a portion which is configured to engage one of said receiving portions;

wherein when one of said blocks engages one of said receiving portions, a musical sequence is played by the toy, and wherein each of said plurality of blocks is generally shaped like a cube and each face of the cube is configured to engage one of said receiving portions.

2. The musical toy of claim 1, wherein each of said plurality of blocks causes a different musical sequence to be played by the toy.

3. The musical toy of claim 1, wherein the musical sequence played by the toy is dependent upon which face of said cube is engaged with one of said receiving portions.

4. The musical toy of claim 3, wherein each cube cause a different musical sequence to be played by the toy.

5. The musical toy of claim 4, wherein a plurality of cubes are engaged with a plurality of receiving portions; and wherein the positioning and orientation of the cubes in the receiving portions determines which of a plurality of musical sequences will be played by the musical toy.

6. The musical toy of claim 5, wherein the positioning and orientation of each of said cubes in each of said receiving portions is readily changeable to create the plurality of musical sequences.

7. The musical toy of claim 6, further comprising a play button and wherein activating the play button causes the toy to play the plurality of musical sequences determined by the positioning and orientation of said cubes in said receiving portions.

8. An educational musical toy for children, the toy allowing one or more musical sequences to be played according to a pattern determined by a child, the toy comprising:

a base with a signal processing unit and machine readable storage media;

a plurality of receiving portions, each of said receiving portions including a first contact which is in communication with said signal processing unit; and a plurality of blocks, each of said plurality of blocks configured to engage one of said plurality of receiving portions, each of said blocks including a second contact, said second contact is configured to be in communication with said first contact when said block is engaged with one of said plurality of receiving portions.

9. The educational toy of claim 8, wherein when one of said blocks is engaged with one of said receiving portions, the musical toy plays a musical sequence.

10. The educational toy of claim 8, wherein the positioning of said plurality of blocks in said plurality of receiving portions determines which of a plurality of musical sequences will be played by the musical toy.

11. The educational toy of claim 8, wherein the signal processing unit produces command signals corresponding to the location and orientation of the blocks in the receiving portions.

12. The educational toy of claim 8, further comprising one or more speakers in communication with said signal processing unit, said speakers producing sounds corresponding to an output signal from said signal processing unit.

13. The educational toy of claim 8, wherein each of said plurality of blocks is generally shaped like a cube and each side of the cube is configured to contact at least one of the receiving portions.

14. The musical toy of claim 13, wherein the musical sequence played by the toy is determined at least in part by the side of the cube which is in contact with the receiving portion.

15. A musical toy which allows one or more musical sequences to be played, comprising:

a base including a programmable computer with computer readable memory storage, said computer configured to produce one or more output signals and receive one or more input signals;

a speaker in communication with said computer and configured to produce sounds corresponding to an output signal from said computer;

a plurality of first receiving portions in communication with said computer, each of said first receiving portions including a sensor; and a plurality of objects having at least one portion configured to contact at least one of said first receiving portions;

wherein when one of said objects is in contact with one of said first receiving portions, said computer determines which of said objects is in contact with which of said first receiving portions, wherein each of said objects has a plurality of portions configured to contact at least one of said first receiving portions; and wherein said computer determines a musical sequence to be played by the toy; wherein said musical sequence is determined at least in part by which of said plurality of portions of said object is in contact with which of said first receiving portions.

16. A musical toy which allows one or more musical sequences to be played, comprising:

a base including a programmable computer with computer readable memory storage, said computer configured to produce one or more output signals and receive one or more input signals;

a speaker in communication with said computer and configured to produce sounds corresponding to an output signal from said computer;

a plurality of first receiving portions in communication with said computer, each of said first receiving portions including a sensor; and a plurality of objects having at least one portion configured to contact at least one of said first receiving portions;

wherein when one of said objects is in contact with one of said first receiving portions, said computer determines which of said objects is in contact with which of said first receiving portions, further comprising a second receiving portion in communication with said computer.

17. The musical toy of claim 16, further comprising a cartridge configured to contact said second receiving portion, wherein said cartridge is used to program the computer to play preselected music.

18. A musical toy, comprising:

a base including a speaker, a signal processing unit and a plurality of receiving portions;

a plurality of blocks, each of said blocks having a plurality of sides configured to contact one of said receiving portions;

means for determining which block is in which receiving portion; and means for playing a musical sequence, wherein the musical sequence is determined at least in part according to which of said plurality of blocks is in which of said plurality of receiving portions.

19. A musical toy, comprising:

a base including a speaker, a signal processing unit and a plurality of receiving portions;

a plurality of blocks, each of said blocks having a plurality of sides configured to contact one of said receiving portions;

means for determining which block is in which receiving portion; and means for playing a musical sequence, wherein the musical sequence is determined at least in part according to which one of said plurality of sides of said blocks is in contact with which of said plurality of receiving portions.

20. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, further comprising a play button in communication with said signal processing unit; wherein activation of said play button causes said device to play one or more musical sequences according to the placement of said plurality of blocks in said plurality of receiving portions.

21. The device of claim 20, wherein the device plays one or more musical sequences according to the placement of said plurality of blocks in said plurality of receiving portions.

22. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, wherein each block of said plurality of blocks causes the device to play a different musical sequence when said block is placed in one of said receiving portions.

23. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, wherein the sequence of said plurality of blocks placed in said plurality of receiving portions determines a sequence of musical sounds.

24. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, further comprising a replaceable cartridge in communication with said signal processing unit, said replaceable cartridge configured to provide musical data to said processing unit to allow the device to play music.

25. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, wherein said plurality of blocks comprises a plurality of cubes and wherein each face of said cubes includes identifying indicia.

26. The device of claim 25, wherein the orientation of each of said cubes in each of said receiving portions causes a different musical sequence to be played.

27. The device of claim 25, wherein each of said cubes causes a different musical sequence to by played by the device.

28. The device of claim 25, further comprising one or more musical sequences which are determined by the placement of said cubes in said receiving portions.

29. A device in which one or more musical sequences may be played, comprising:

a base including a signal processing unit and machine readable storage media, said processing unit configured to receive music sequence data and to send an audio signal to a speaker;

a speaker configured to receive said audio signal and produce sounds corresponding to said audio signal;

a plurality of receiving portions in communication with said processing unit; and a plurality of blocks, each of said blocks having a surface configured to engage one of said receiving portions, wherein each of said plurality of blocks are readily movable between each of said plurality of receiving portions to allow the device to readily play different musical sequences.

30. An educational musical toy comprising:

a block having a first side configured to mate with a base of said toy, said first side having contacts configured to engage contacts of said base to complete an electric circuit;

said block contacts being electrically connected to an electrical element in the block that identifies a particular musical sequence in said toy base and causes said particular musical sequence to be audibly played when energized;

said block having a second side having spaced contacts configured to engage contacts of said base, the contacts of said second side being electrically connected by an element within the block which completes a circuit when energized and identifies a particular musical sequence within said toy that is different from the sequence identified by the electrical element connected to said first block contacts, thereby enabling said block to be able to initiate the playing of two different musical sequences.

31. The component of claim 30, wherein said block includes six sides and each of said sides has contacts that are electrically connected and have the capability to identify different musical sequences in said toy base.

32. The component of claim 30, in which said first and second block sides each has four spaced contacts arranged so that in each of two different positions of said block, two of the four contacts will align with two spaced contacts of said toy.

33. The component of claim 30, including a second block similar to said first block wherein the musical sequences triggered by the second block are different from those triggered by the first block.

34. The components of claim 33, wherein faces of the blocks are color-coordinated so that the musical sequences provided by the face of the first block is appropriate to be played in combination with the sequence provided by the same colored face of the second block.

35. An educational musical toy involving one or more musical sequences to be played, creating a pattern determined by the user of the toy, the toy comprising:

a base including a signal processing unit and machine-readable storage media, said storage media containing information to provide a plurality of musical sequences; and a plurality of receiving portions, each of said portions including a first contact which is in communication with said signal processing unit, each of said portions being configured to receive an object having an electrical contact on an exterior surface, each of said receiving portions being configured to cause said second contact to engage said first contact when the object is positioned in the receiving portion, said signal processing unit and said machine-readable storage media being adapted to produce a musical sequence when said contacts are engaged and energized.

36. The toy of claim 35, in which said receiving portions include a square recess adapted to receive a square portion of said object.

37. The toy of claim 35, wherein said receiving portion includes a depressible switch positioned to be depressed by said object, said switch being adapted to energize said storage media when said contacts are engaged.

38. The toy of claim 35 including a slot formed in said base adapted to receive a cartridge configured to cause said signal processing unit and said storage media to produce pre-selected music.

39. The toy of claim 35, in which the musical sequence played by the toy is dependent on which face of the block is engaged with the receiving portion.

40. The toy of claim 35 in which the base in combination with such object forms an RF circuit in combination with said signal processing that cooperates with said media to cause said musical sequences to be played.

* * * * *